United States Patent [19]

Rock et al.

[11] 3,938,219

[45] Feb. 17, 1976

[54] HINGE MOUNTING DEVICE

[75] Inventors: Erich Rock, Hochst; Bernhard Mages, Dornbirn, both of Austria

[73] Assignee: Blum Gesellschaft m.b.H., Hochst, Austria

[22] Filed: Oct. 7, 1974

[21] Appl. No.: 512,883

[30] Foreign Application Priority Data

| | | |
|---|---|---|
| Oct. 10, 1973 | Austria | 8639/73 |
| Feb. 26, 1974 | Austria | 1567/74 |
| Mar. 29, 1974 | Austria | 2635/74 |
| Apr. 2, 1974 | Austria | 2745/74 |

[52] U.S. Cl. ..... 16/130

[51] Int. Cl.[2] ..... E05D 7/04

[58] Field of Search ..... 16/129–134, 16/128 R, 145–147, 180, 182, 150

[56] References Cited

UNITED STATES PATENTS

| | | | |
|---|---|---|---|
| 3,148,407 | 9/1964 | Glasbrenner | 16/129 |
| 3,748,689 | 7/1973 | Granert | 16/129 |
| 3,772,735 | 11/1973 | Lautenschlaeger | 16/129 |

*Primary Examiner*—G. V. Larkin

*Attorney, Agent, or Firm*—Wenderoth, Lind & Ponack

[57] ABSTRACT

A hinge mounting device, particularly for furniture door hinges, includes a hinge casing and a hinge arm interconnected by links pivotally mounted on the hinge casing and the hinge arm by means of pivot pins. The hinge arm is slidable into and fixable onto a mounting plate that is securable to a furniture element, for example a side wall.

21 Claims, 9 Drawing Figures

HINGE MOUNTING DEVICE

BACKGROUND OF THE INVENTION

1. Field of the invention

The present invention relates to a hinge mounting device, particularly for a furniture door, and including a mounting plate securable to a furniture element and a hinge arm with links mounted on the mounting plate.

2. Description of the Prior Art

Heretofore hinge arms have been secured either directly to a mounting plate by means of counteracting fixing screws, or were fixed onto a slide piece that slidably fitted into guides of the mounting plate and that was then secured to the mounting plate, e.g., also by a fixing screw.

These hinge mounting devices have the advantage that the mounting plate may be screwed onto the furniture element without the necessity of the other furniture element, in most cases the door, being held.

Later when the door is mounted, the hinge arm which is connected to the hinge casing, the latter being fitted into a respective bore of the door, is secured to the mounting plate.

Still however, the mounting and fixing of the hinge arm on the mounting plate while carrying the door requires considerable skill, and in many cases two people to achieve.

Another requirement of such hinge mounting devices is that the hinge mounting device allow an adjustment of the hinge and the door when the hinge arm is already mounted on the mounting plate. The necessity of adjustment possibilities in the direction of the depth of the furniture and of the amount of the gap between the door and adjacent furniture panel are due to inaccuracies that may occur while drilling the bores for the hinge casing or for the screws that hold the mounting plate.

SUMMARY OF THE INVENTION

With the above discussion in mind, the present invention provides a hinge mounting device, particularly for furniture doors, including a mounting plate that is fixable on a furniture element and a hinge arm mountable and securable on the mounting plate, the hinge arm carrying links that are connected to a hinge casing or the like. The hinge arm, near the front end thereof, is mounted on a slide piece that is insertable into guides of the mounting plate. The hinge arm, at the rear end thereof, is directly mounted and secured onto the mounting plate.

The hinge arm may have an arresting lip or projection that engages in a holding slot in the mounting plate, the arresting lip being integral with the hinge arm and being bendable in order to permit an adjustment of the hinge in the direction of the depth of the furniture.

The mounting plate may have an abutment for contact by an adjustment tool to be used in the manner of a fulcrum by action of a tool extending through a corresponding opening in the hinge arm.

To facilitate the mounting of the hinge arm on the mounting plate, there may be provided a spring tongue on at least one side of the holding slot and constituting an edge or rim of the holding slot.

The tongue may be an integral part of the mounting plate, the mounting plate being made of plastic.

The mounting plate may have two symmetrical holding slots, so that while fixing the mounting plate to the furniture element there is no need to take care which side of the mounting plate extends forwardly.

The slide piece may be in the form of a sheet metal clamp.

To provide a rigid assembly the slide piece may have guide surfaces for guiding corresponding surfaces of the hinge arm.

To prevent tilting and jamming of the slide piece during the insertion thereof into the guides of the mounting plate, the hinge arm may have lateral clearances in which the slide piece is held.

It is advantageous that the mounting plate be made of a plastics material, while the hinge arm and other parts be made of metal, so that a hinge mounting assembly of high capacity strength at a low price is obtained.

It is an object of the present invention to provide a hinge mounting device which is simple in construction and function and which can be produced at low costs.

BRIEF DESCRIPTION OF THE DRAWINGS

The invention will be described in detail hereinafter with reference to the attached drawings, although the invention is not intended to be restricted to the specific embodiments shown.

DETAILED DESCRIPTION OF THE INVENTION

Figure 1:
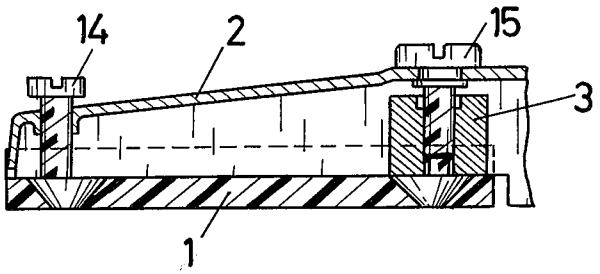
FIG. 1 is a longitudinal section through a hinge mounting device according to the invention.

As it can be seen from the drawings, the hinge mounting device of the invention consists mainly of a mounting plate 1, a hinge arm 2 and a slide piece 3.

The hinge arm 2 is connected with the hinge casing 5 by links 8 pivotally secured by pivot pins 4.

Figure 7:
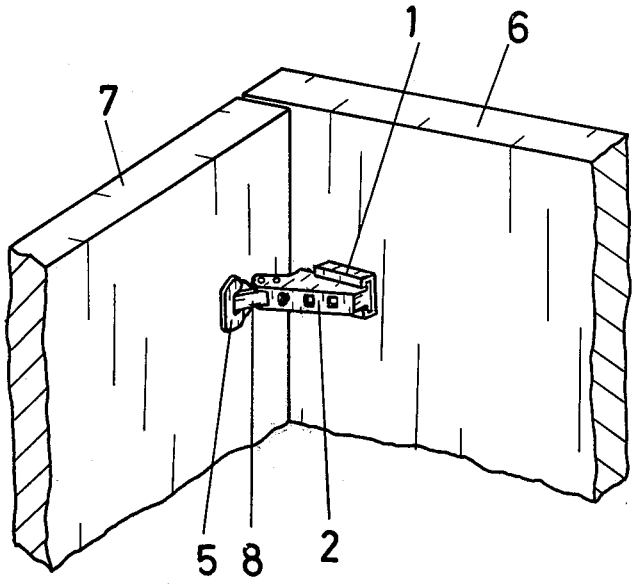
FIG. 7 is a perspective view showing the connection of a furniture door with a furniture side-wall effected by a hinge with a hinge mounting device according to the invention.

As it can be seen from FIG. 7 the hinge arm 2 is fixed onto the furniture side wall 6 by means of the mounting plate 1, while the hinge casing 5 is inserted into the furniture door 7.

The mounting plate 1 has opposite lateral guides or recesses 9 into which opposite lateral rims or projections 10 of the slide piece 3, as well as the opposite lateral rims or projections 11 of the hinge-arm 2, can be inserted.

Thus, the hinge arm 2 is first directly anchored onto the mounting plate 1, while a second anchoring thereof is effected by means of the slide piece 3.

This arrangement permits an adjustment in the direction of the depth of the furniture, as well as in the direction of the door gap, although the hinge mounting device is of extremely simple construction.

For example, pedestals 13 on opposite sides of the slide piece 3 project into corresponding clearances or slots 12 in opposite sides of the hinge arm 2, thus providing a fixed guiding of the slide piece 3 in the hinge arm 2, which prevents the slide piece 3 from being twisted during adjustment of the hinge arm 2 in the direction of the depth of the piece of furniture.

It should be mentioned that only the ends of the mounting plate 1 are provided with guides 9. Thus the hinge arm 2 need not be inserted into the mounting plate 1 from the front thereof and over the whole length of the mounting plate 1, but rather it may be positioned onto the mounting plate and anchored thereon by a short movement into the guides 9.

This embodiment makes it possible for plural hinge arms 2 to be inserted one after the other into their respective mounting plates 1 when the door is being assembled, as tilting of the hinge arm 2 and the mounting plate 1 is virtually impossible.

After the hinge arm 2 has been adjusted in the direction of the depth of the furniture it is fixedly positioned by means of the mounting screw 14 which abuts against the mounting plate 1.

Thereafter, the adjustment of hinge arm 2 in the direction of the gap between wall 6 and door 7 may be carried out by turning the adjustment screw 15 which fits into a thread in the slide piece 3 and is riveted or otherwise attached to the hinge arm 2. That is, rotation of screw 15 will move hinge arm 2 toward or away from slide piece 3, and thus also furniture side wall 6.

Figure 2:
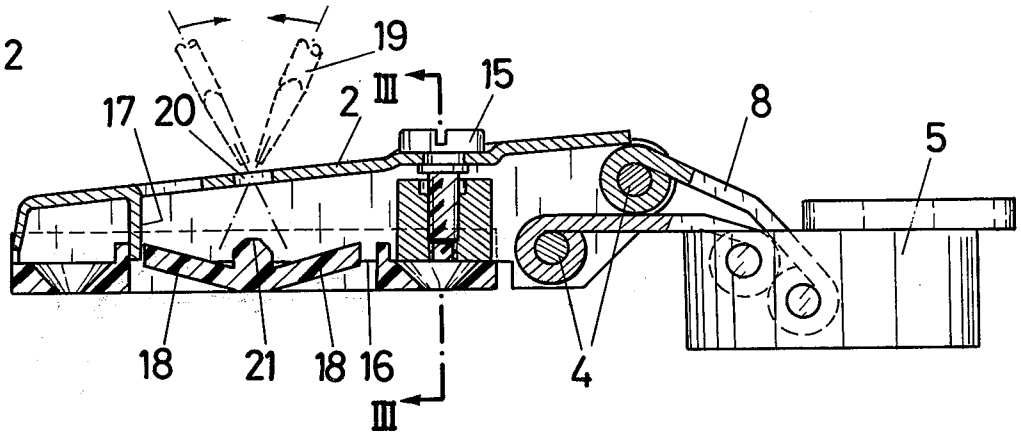
FIG. 2 is a longitudinal section through a variation of the hinge mounting device according to the invention.
Figure 3:
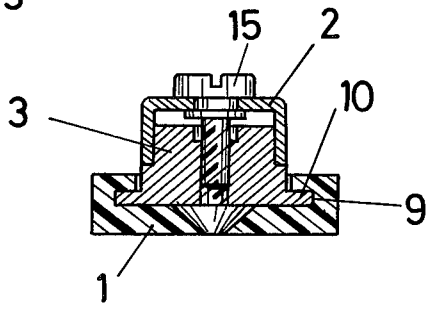
FIG. 3 is a section along the line III—III of FIG. 2.
Figure 4:
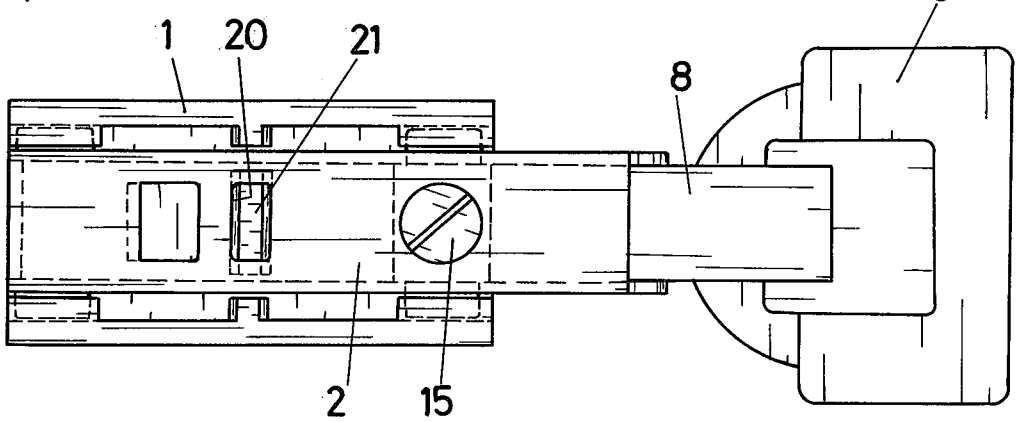
FIG. 4 is a plan view of the hinge mounting device according to FIG. 2.
Figure 5:
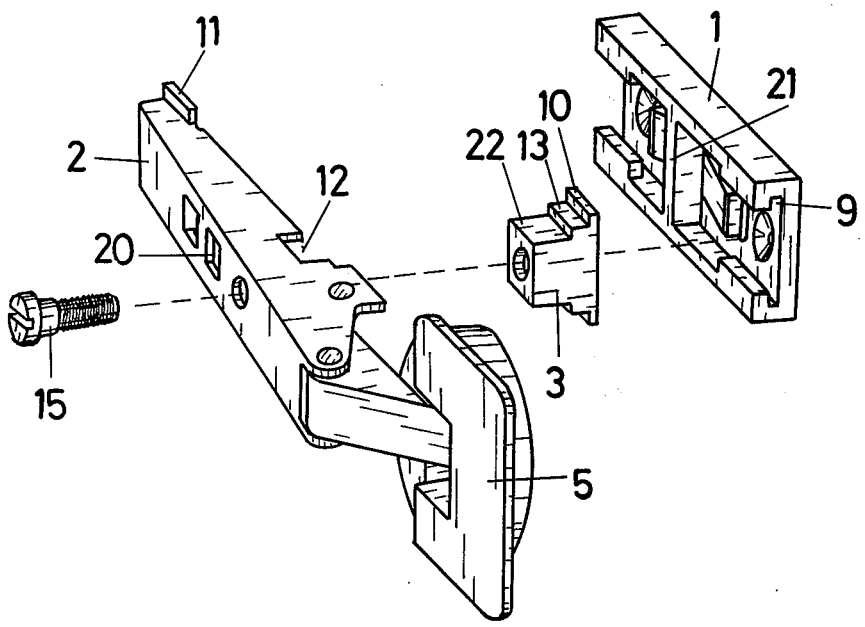
FIG. 5 is an exploded perspective view of a hinge mounting device according to the invention.

In a further embodiment of the hinge mounting device according to the invention, the mounting plate 1 has one or preferably two, as shown in the embodiment according to FIG. 2, holding slots 16 into which fit an arresting lip or projection 17 of hinge arm 2 after the hinge arm 2 has been mounted on plate 1.

In order to facilitate insertion of the arresting projection 17, which is as can be seen from FIG. 2 integral with the hinge arm 2, each holding slot 16 has adjacent thereto at least one spring tongue 18 which may be depressed downwardly.

Also in this embodiment, the hinge arm 2 can be positioned on the mounting plate 1 and moved longitudinally thereof to slide projections 11 into the guides 9, whereby the hinge arm 2 is fixed on the mounting plate when the arresting projection 17 snaps into or comes to rest in the particular holding slot 16.

The position of the hinge arm 2 may then be adjusted in the direction of the depth of the furniture by means of a tool, for example such as a screw driver 19, extending through the opening 20 in the hinge arm 2 and contacting the abutment 21 of the mounting plate 1 as a fulcrum for moving arm 2 to the right or left as viewed in FIG. 2.

The arresting projection 17 and tongue 18 are bendable so that by means of the screw driver the hinge arm may be longitudinally displaced and repositioned.

The adjustment of the size of the gap between door 7 and side wall 6 is obtained by means of the adjustment screw 15, as discussed above.

To render the hinge mounting device extremely rigid the sides of the slide piece 3 may be formed to constitute guide planes 22 for contact with the interior side surfaces of the hinge arm 2.

Figure 6:
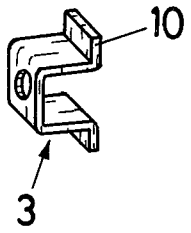
FIG. 6 is a perspective view of a modified slidepiece.

FIG. 6 shows an embodiment of the slide piece 3 which is particularly inexpensive to manufacture, the slide piece 3 consisting of a U-shaped clamp stamped out of, e.g., sheet metal.

It is to be noted that the rims or projections 11 of the hinge arm 2 and the rims or projections 10 of the slide piece 3 are directed laterally outwardly. This greatly facilitates stamping and forming of the hinge arm 2 and the slide piece 3.

Figure 8:
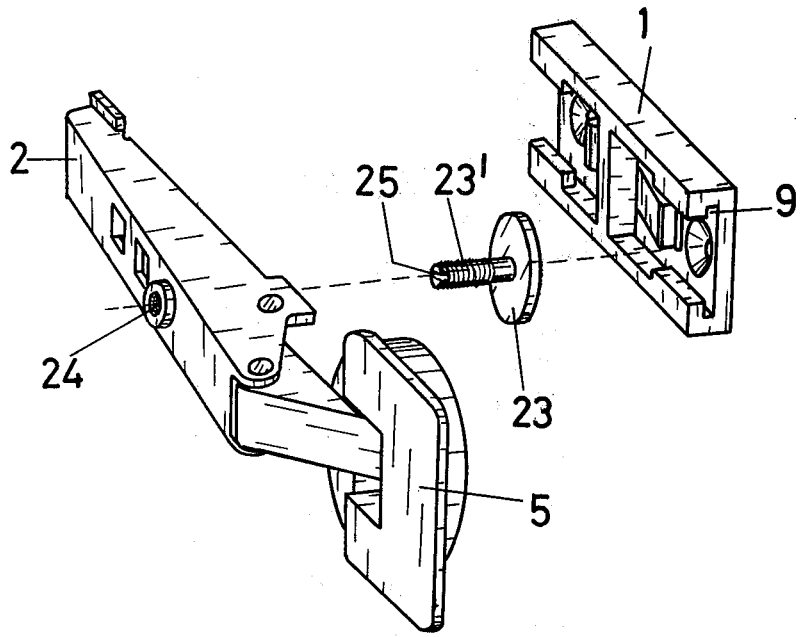
FIG. 8 is an exploded perspective view of a further embodiment of a hinge mounting device according to the invention.
Figure 9:
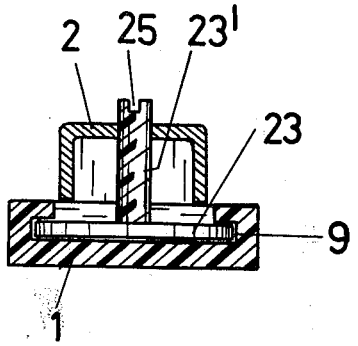
FIG. 9 is a section in the area of the slide piece of a hinge mounting device according to FIG. 8.

In the embodiment shown in FIGS. 8 and 9, the slide piece 3 consists of a circular shim member 23 with an axial stud 23′ extending perpendicularly therefrom. The axial stud 23′ is threaded at least on its outer end, which thread when the hinge mounting device is assembled fits into a threaded bore 24 in the hinge arm 2.

By turning the slide piece 3, and specifically the stud 23′ thereof, by means of a screw driver engaging in the slot 25, the gap between the door 7 and the side wall 6 can be adjusted.

Various modifications may be made to the specific structural arrangements described above without departing from the scope of the invention.

What I claim is:

1. A hinge mounting device, particularly for use with furniture doors, said device comprising:
   - a mounting plate attachable to a wall of a piece of furniture to extend in a depthwise direction thereof;
   - a slide piece slidably attached to said mounting plate to slide in said depthwise direction; and
   - a hinge arm having thereon means for connection to a door of said piece of furniture, said hinge arm having a first end and a second end with respect to said depthwise direction, said first end being fixed to said slide piece, and said second end being slidably attached to said mounting plate to slide in said depthwise direction.

2. A device as claimed in claim 1, wherein said first end of said hinge arm is the forward end thereof and said second end of said hinge arm is the rearward end thereof, as viewed in said depthwise direction.

3. A device as claimed in claim 1, wherein said mounting plate has therein first laterally spaced recesses extending in said depthwise direction, and second laterally spaced recesses extending in said depthwise direction.

4. A device as claimed in claim 3, wherein said second end of said hinge arm has laterally spaced projections extending in said depthwise direction, said projections being slidably received in said second recesses of said mounting plate.

5. A device as claimed in claim 4, wherein said slide piece has laterally spaced projections extending in said depthwise direction, said projections of said slide piece being slidably received in said first recesses of said mounting plate.

6. A device as claimed in claim 4, wherein said slide piece comprises a circular shim member, opposite peripheral edges of said shim member being received in said first recesses of said mounting plate.

7. A device as claimed in claim 4, wherein said first and second recesses face inwardly of said mounting plate, and said projections of said hinge arm extend outwardly therefrom.

8. A device as claimed in claim 1, further comprising means for fixing the position of said hinge arm with respect to said mounting plate in said depthwise direction.

9. A device as claimed in claim 8, wherein said fixing means comprises a mounting screw threaded through said hinge arm at said second end thereof and abutting said mounting plate.

10. A device as claimed in claim 8, wherein said fixing means comprises at least one laterally extending holding slot formed in said mounting plate, and a lateral arresting lip integral with said hinge arm and extending therefrom toward said mounting plate and received in said holding slot.

11. A device as claimed in claim 10, further comprising a flexible spring tongue element adjacent each said holding slot and forming an edge thereof.

12. A device as claimed in claim 10, wherein said at least one holding slot comprises two holding slots spaced in said depthwise direction.

13. A device as claimed in claim 10, wherein said lip is flexible in said depthwise direction.

14. A device as claimed in claim 13, further comprising an abutment on said mounting plate, and an adjacent opening in said hinge arm, a tool being insertable through said opening to abut said abutment as a fulcrum and urgable against said hinge arm to move the same in said depthwise direction.

15. A device as claimed in claim 1, further comprising means for adjusting the spacing between said mounting plate and said hinge arm.

16. A device as claimed in claim 15, wherein said adjusting means comprises an adjustment screw rotatably fixed to said hinge arm and extending therethrough, and said adjustment screw being adjustably threaded into said slide piece.

17. A device as claimed in claim 15, wherein said slide piece comprises a circular shim member, and said adjusting means comprises a threaded stud extending from said shim member, said threaded stud being adjustably threadably received in said hinge arm and extending therethrough.

18. A device as claimed in claim 17, wherein said stud has on the end thereof remote from said shim member an adjustment tool receiving means.

19. A device as claimed in claim 1, wherein said slide piece comprises a U-shaped sheet metal clamp.

20. A device as claimed in claim 1, wherein said slide piece has opposite lateral planar surfaces contacting corresponding interior surfaces of said hinge arm.

21. A device as formed in claim 1, wherein said hinge arm has opposite lateral sides each having therein a clearance, said slide piece being received in said clearances.

* * * * *